US005746502A

United States Patent [19]

Huang

[11] Patent Number: 5,746,502

[45] Date of Patent: May 5, 1998

[54] RECEPTACLE STRUCTURE FOR FLUORESCENT LAMP

[76] Inventor: Tseng-Tsai Huang, No. 18-1, Tung-Feng Street, Shu-Lin, Taipei, Taiwan

[21] Appl. No.: 725,091

[22] Filed: Oct. 2, 1996

[51] Int. Cl.[6] ..... F21S 3/02

[52] U.S. Cl. ..... 362/223; 362/260; 362/334; 362/338; 362/361

[58] Field of Search ..... 362/217, 223–225, 362/332–334, 336–340, 361, 375, 260

[56] References Cited

U.S. PATENT DOCUMENTS

| | | | |
|---|---|---|---|
| 2,281,376 | 4/1942 | Ohm | 362/223 |
| 2,334,005 | 11/1943 | Hoeveler | 362/223 |
| 3,760,178 | 9/1973 | Miller | 362/223 |
| 4,573,111 | 2/1986 | Herst et al. | 362/223 |
| 4,876,633 | 10/1989 | Engel | 362/223 |

*Primary Examiner*—Alan Cariaso
*Attorney, Agent, or Firm*—Bacon & Thomas

[57] ABSTRACT

A receptacle structure for a fluorescent lamp, wherein a light refracting plate is arched upwardly and is provided beneath two wing plates of an elongated base of the receptacle structure, the inner bottom face of the refracting plate is in an undulated form and is arched in a contrary direction to that of an arched and undulated lamp shade, thus an elliptical hermetic space is provided for hidding a lamp pipe (which is secured by two end fixing-seats provided on the two ends of the elongated base) between the lamp shade (which is engaged by two end fixing-caps for preventing it from dropping) and the refracting plate, thereby light projecting through the refracting plate and the lamp shade can be more uniform, the lamp pipe will no more be exposed to be covered with dust, appearance of the whole lamp can be more beautiful.

4 Claims, 4 Drawing Sheets

RECEPTACLE STRUCTURE FOR FLUORESCENT LAMP

BACKGROUND OF THE INVENTION

1. Field of the Invention

The present invention relates to a receptacle structure for a fluorescent lamp, wherein a hermetic receptacle is provided for various conventional fluorescent lamps, thereby projecting light can be more uniform, and the lamp pipe will no more be exposed to be covered with dust to reduce its illumination effect.

The lamp pipe of a fluorescent lamp of earlier types is exposed to directly illuminate by projecting light from the lamp pipe. The exposed pipe is subjected to contamination of dust to reduce its brightness, yet it is uneasy to be cleaned, when in cleaning, the lamp pipe must be dismantled for wipping, this is inconvevient in use, and is inelegant in appearance.

2. Description of the Prior Art

Most part of a conventional fluorescent lamp, except in some lesser designs wherein the lamp pipes thereof are exposed, is designed to have its lamp pipe hidden in its hermetic receptacle, light therefrom only gives illumination after getting through a lamp shade, therefore, the lamp pipe is no more subjected to contamination of dust, when in cleaning, the lamp pipe does not have to be dismantled, it can be wipped directly.

However, such conventional fluorescent lamps having their lamp pipes hidden in their hermetic receptacles are mostly bad in illumination, the hermetic receptacles thereof are mostly rectangular, they look dull and are lack of variety, this is not coincedent with the tide of lamp designing and thus is not welcome by most customers who ask for beautiful modelling.

SUMMARY OF THE INVENTION

In view of this, the inventor of the present invention provides a receptacle structure for a fluorescent lamp, which can get rid of disadvantage resided in the conventional techniques, based on his professional experience of years in manufacturing and selling the like products and after continuous study and improving.

Particularly, the receptacle structure for a fluorescent lamp of the present invention includes an elongated base, a light refracting plate, a lamp shade, two end fixing-seats and two end fixing-caps. Wherein:

The elongated base is provided with a trough shaped receiving space on the top thereof in which a ballast and a starter for the fluorescent lamp can be provided, the elongated base can be fixed through the top plate thereof on a ceiling or a wall, the lateral plates on both sides thereof are bevelly extended outwardly to form wing plates.

The light refracting plate is arched upwardly to form an arc shaped end section and is provided beneath the trough shaped receiving space and between the two wing plates, the light refracting surface on the bottom face thereof is in an undulated form.

The shape of the lamp shade is arciform just corresponding to that of the light refracting plate, the lamp shade is provided beneath the light refracting plate to form with the light refracting plate a generally elliptical space for receiving the lamp pipe of the fluorescent lamp, material of the lamp shade is transparent acrylic, the bottom thereof is undulated.

The two end fixing-seats can be fixed on the two ends of the trough shaped receiving space in the elongated base, the bottoms thereof are provided each with a connector for the lamp pipe and can be connected exactly with the two ends of the lamp pipe between the light refracting plate and the lamp shade. When electric power is on, the lamp pipe can be lightened between the light refracting plate and the lamp shade through connecting to the connectors for the lamp pipe.

The two end fixing-caps can be fixed on two ends of the two wing plates of the elongated base, the inner bottom surfaces thereof are in undulated shape like that of the bottom of the lamp shade, they can be fixedly engaged with the two ends of the bottom surface of the lamp shade to fix the lamp shade.

By the above stated structure, when the fluorescent lamp is lightened through the ballast, the starter and the connectors for the lamp pipe on the fixing-seats, light is refracted by the undulated light refracting plate, and emited through the undulated bottom surface of the lamp shade, the emitted ray of light can thus be more uniform; appearance of the whole receptacle structure for the fluorescent lamp can be more beautiful by having the undulated bottom surface of the lamp shade and arciform design as well as covering of the same lamp shade on the outwardly extended wing plates; moreover, when in assembling, by providing of the ballast and the starter in the elongated base, and by providing of the light refracting plate and the two end fixing-seats, and by mounting of the lamp shade after fixing of the lamp pipe, then by fixing of the two end fixing-caps, the whole set of fluorescent lamp is completed, such assembling is very fast and convenient.

Accordingly, the gist of the receptacle structure for a fluorescent lamp of the present invention is to provide a hermetic receptacle which is different from various conventional fluorescent lamps, and to achieve the objects of having more uniform light projecting, more beautiful appearance and more convenient assembling.

The present invention will be apparent in its practical structural characteristics after reading the detailed description of the preferred embodiment thereof in reference to the accompanying drawings.

DETAILED DESCRIPTION OF THE PREFERRED EMBODIMENT

Figure 1:
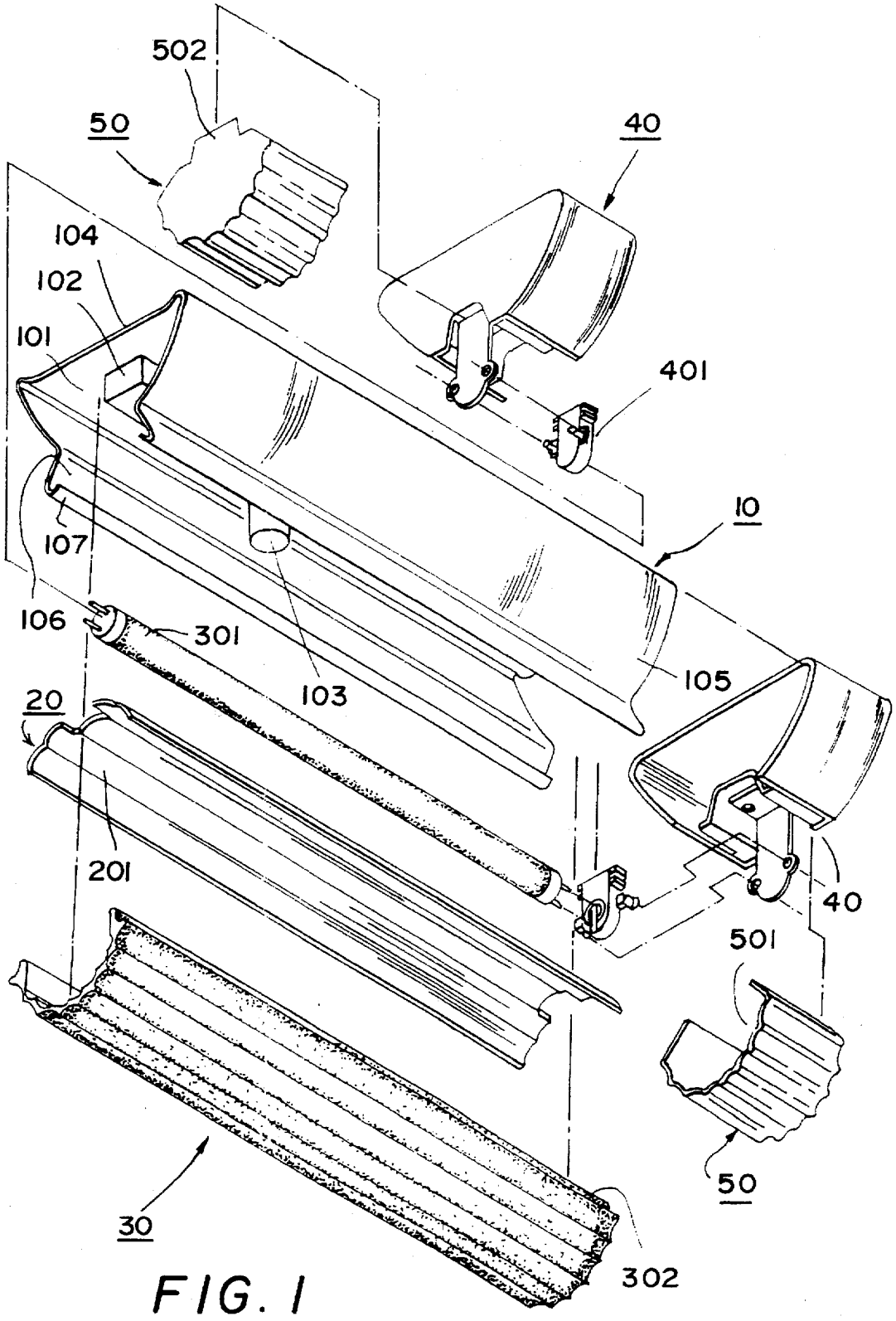
FIG. 1 is an analytical perspective view of the present invention.

In the drawings:

It can be seen from FIG. 1 that, the receptacle structure for a fluorescent lamp of the present invention includes an elongated base 10, a light refracting plate 20, a lamp shade 30, two end fixing-seats 40 and two end fixing-caps 50. Wherein:

The elongated base 10 is provided with a trough shaped receiving space 101 on the top thereof in which a ballast 102 and a starter 103 for the fluorescent lamp can be provided, the elongated base 10 can be fixed on a ceiling or a wall through a top plate 104 thereof, the lateral plates 105 on both sides thereof are bevelly extended outwardly to form wing plates 106, the ends of the wing plates 106 are slightly curved to form limiting edges 107.

Figure 4:
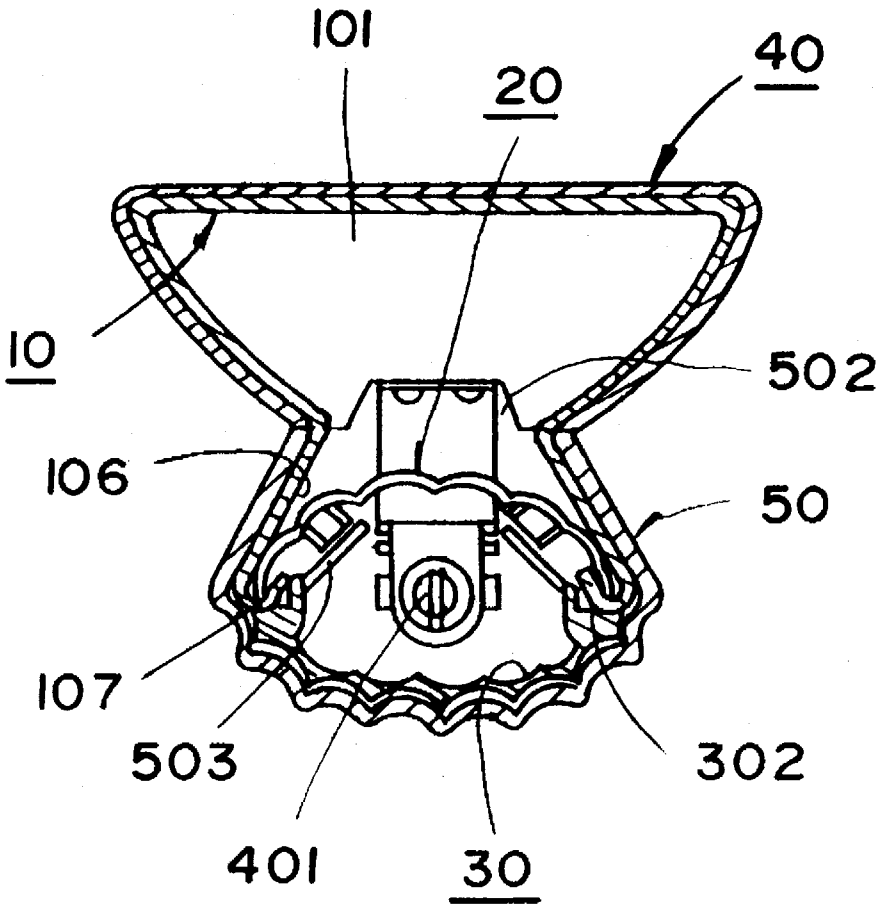
FIG. 4 is a lateral sectional view of the present invention after assembling.

The light refracting plate 20 is arched upwardly to form an arc shaped end section and is provided beneath the trough shaped receiving space 101 and between the two wing plates 106, the bottom of both sides thereof can be engaged by the limiting edges 107 to be prevented from dropping (as shown in FIG. 4), the light refracting surface 201 on the bottom face thereof is in an undulated form.

The shape of the lamp shade 30 is arciform just corresponding to that of light refracting plate 20, the lamp shade 30 is provide beneath the light refracting plate 20 to form with the light refracting plate 20 a generally elliptical space (FIG. 4) for receiving the lamp pipe 301 of the fluorescent lamp, material of the lamp shade 30 is transparent acrylic, the bottom thereof is undulated, each side on the top thereof is provided with an engaging edge 302 engaging in each limiting edge 107 on the ends of the above mentioned wing plates 106.

The two end fixing-seats 40 can be fixed on the two ends of the trough shaped receiving space 101 in the elongated base 10, the bottoms thereof are provided each with a connector 401 for the lamp pipe 301 and can be connected exactly with the two ends (FIG. 2) of the lamp pipe 301 between the light refracting plate 20 and the lamp shade 30. When electric power is on, the lamp pipe 301 can be illuminated between the light refracting plate 20 and the lamp shade 30 through connecting of the connectors 401 for the lamp pipe 301.

The two end fixing-caps 50 can be fixed on two ends of the two wing plates 106 of the elongated base 10, the inner bottom surfaces 501 thereof are in undulated shape like that of the bottom of the lamp shade 30, they can be fixedly engaged with the two ends of the bottom surface of the lamp shade 30 to fix the lamp shade 30 not to drop.

Figure 2:
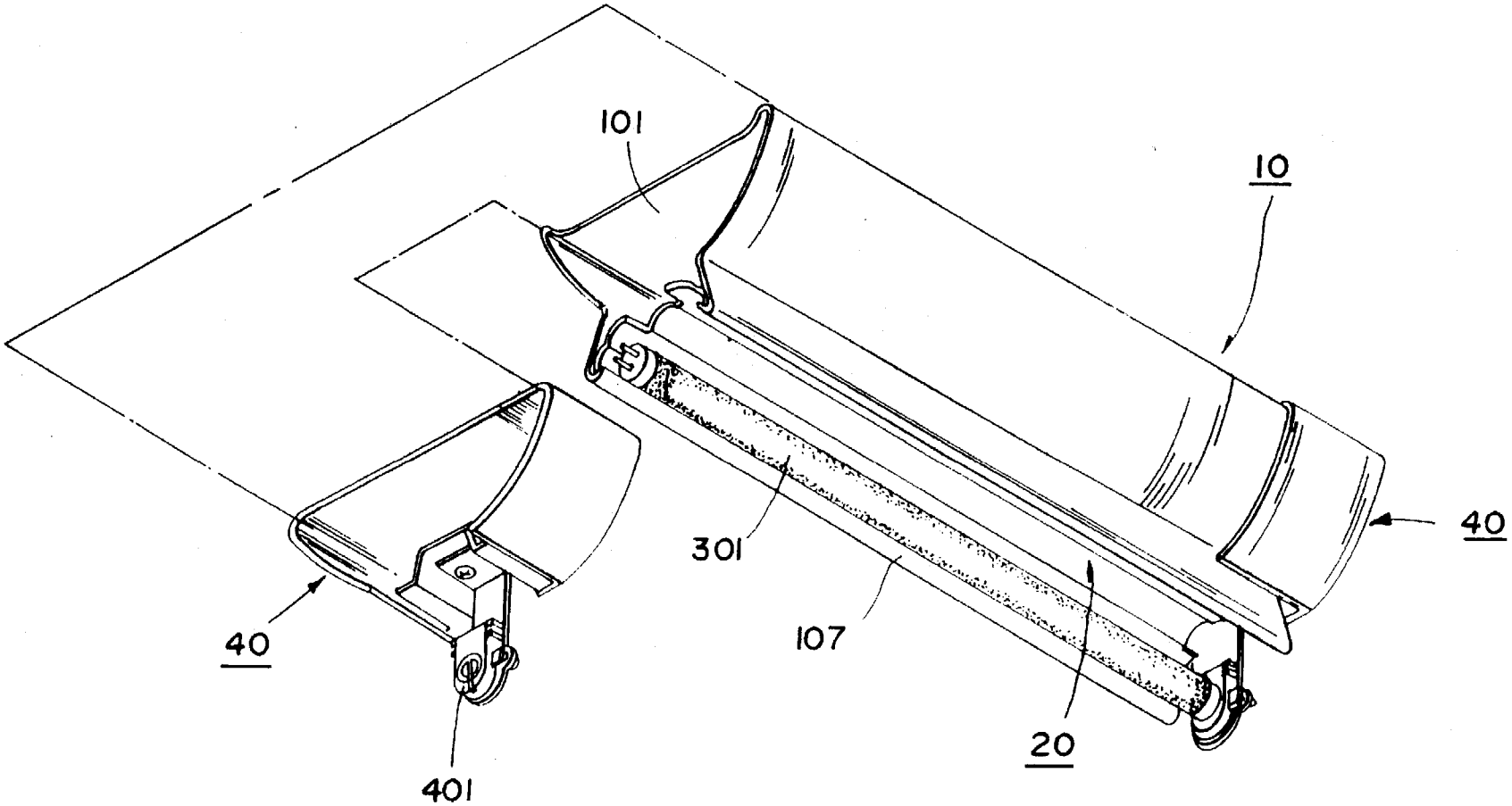
FIG. 2 is a schematic perspective view showing assembling of the light refracting plate, the two end fixing-seats, and the lamp pipe on the elongated base of the present invention.
Figure 3:
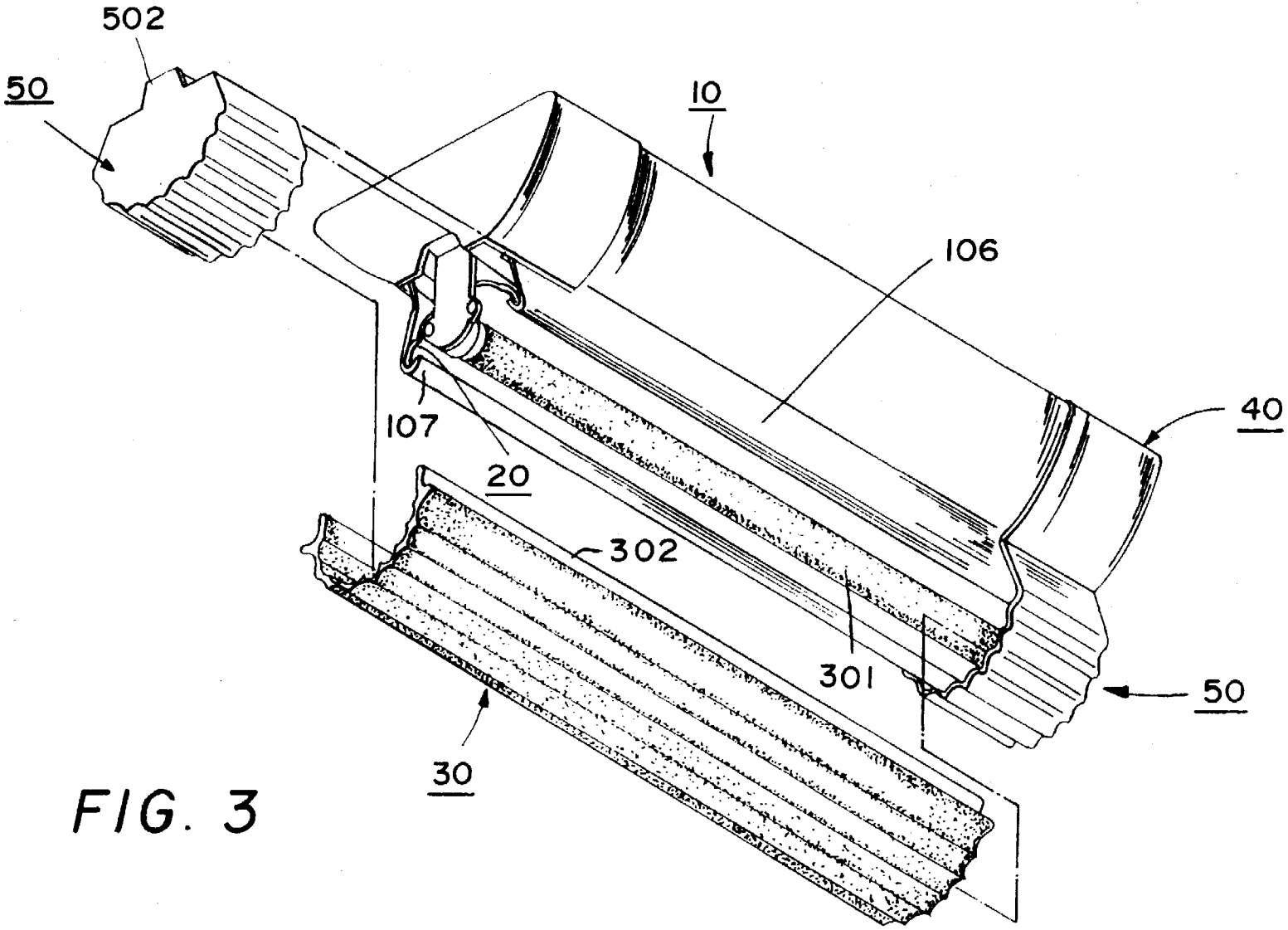
FIG. 3 is a schematic perspective view showing assembling of the lamp shade with the two end fixing-seats of the present invention.

Please refer to FIG. 2, 3 and 4, when in assembling, by providing of the ballast 102 and the starter 103 in the trough shaped receiving space 101 of the elongated base 10 (FIG. 1), and by providing of the light refracting plate 20 beneath the trough shaped receiving space 101 (FIG. 2), by engaging the bottom of both sides of the light refracting plate 20 in the limiting edges 107 to be secured, and then by fitting the two end fixing-seats 40 over the two ends of the trough shaped receiving space 101 of the elongated base 10, and by mounting of the lamp pipe 301 by means of the connectors 401 for the lamp pipe 301, when electric power is on in this state, the lamp pipe 301 is lightened for illumination, to add esthetical beauty to such assembly, when assembling of the lamp pipe 301 is completed, the engaging edges 302 of the lamp shade 30 will engage in the limiting edges 107 on the ends of the above mentioned wing plates 106 (FIG. 3), then the two end fixing-caps 50 can be fixed on two ends of the two wing plates 106 and abutted against the two ends of the lamp shade 30, light at the bottom of the lamp pipe 301 will directly project through the undulated bottom of the lamp shade 30 (FIG. 4), while the light on the top of the lamp pipe 301 will be refracted via the light refracting surface 201 on the bottom face of the light refracting plate 20 and then be projected through the lamp shade 30, in this way, light emitted from the lamp shade 30 can be more uniform as well as brighter, besides, undulatory form of the lamp shade 30 and the two end fixing-caps 50 can make the fluorescent lamp beautiful. Moreover, we can see from the above statement that the present invention is quite convenient in assembling, and it can save work hour and is favorable for mass production. Further, to prevent light beam from emitting through the gaps between the two end fixing-caps 50 and the two end fixing-seats 40, each top end of the two end fixing-caps 50 can be provided with an extended light covering plate 502 (FIG. 3, 4) and two ribs 503 which is provided on the inner surface of each of the two end fixing-caps 50 for preventing emitting of light when the two end fixing-caps 50 and the two end fixing-seats 40 are engaged together.

My invention may assume numerous forms and is to be construed as including all modifications and variations falling within the scope of the appended claims.

I claim:

1. A receptacle structure for a fluorescent lamp including:

an elongated base having a top and lateral plates extending downwardly from the top defining a trough shaped receiving space in which a ballast and a starter for said fluorescent lamp can be provided, said elongate base being able to be fixed on a ceiling or a wall through a top plate of said elongated base, the lateral plates on both sides of said elongated base being bevelly extended outwardly to form wing plates;

a light refracting plate provided beneath said trough shaped receiving space and between said two wing plates and being arched upwardly to form an arc shaped end section, a bottom face of said light refracting plate thereof being a light refracting surface and being in an undulated form;

a lamp shade provided beneath said light refracting plate, being arciform just opposite in direction to said arc shape of said light refracting plate, both sides on top of said lamp shade being engaged with bottom ends of said wing plates, said lamp shade thus forming a generally elliptical space with said light refracting plate for receiving a lamp pipe of said fluorescent lamp, material of said lamp shade being transparent acrylic, a bottom surface of said lamp shade being undulated;

two end fixing-seats being able to be fixed on two opposite ends of said trough shaped receiving space in said elongated base, bottoms of said fixing-seats are provided each with a connector for the lamp pipe and being connected exactly with two ends of said lamp pipe between said light refracting plate and said lamp shade, so that said lamp pipe is able to be illuminated; and two end fixing-caps being able to be fixed on two opposite ends of said two wing plates, inner bottom surfaces of said fixing-caps being in undulated shape like that of the bottom of said lamp shade, said end fixing-caps being able to be fixedly engaged with two opposite ends of the bottom surface of said lamp shade to fix the lamp shade not to drop.

2. A receptacle structure for a fluorescent lamp as claimed in claim 1, wherein:

said wing plates are slightly curved upwardly to form limiting edges, the bottom of both sides of said light refracting plate can be engaged by said limiting edges to be prevented from dropping.

3. A receptacle structure for a fluorescent lamp as claimed in claim 1 wherein:

said lamp shade is provided with engaging edges on its top for engaging the bottom ends of said wing plates.

4. A receptacle structure for a fluorescent lamp as claimed in claim 1, wherein:

a light covering plate is extended down from each of said fixing-caps, and two ribs are extended inwardly of said fixing-cap.

* * * * *